US008447207B2

(12) United States Patent
Aoshima

(10) Patent No.: US 8,447,207 B2
(45) Date of Patent: May 21, 2013

(54) PROTECTIVE SHEET, IMAGE FORMING UNIT AND IMAGE FORMING APPARATUS

(75) Inventor: Taku Aoshima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 501 days.

(21) Appl. No.: 12/547,617

(22) Filed: Aug. 26, 2009

(65) Prior Publication Data

US 2010/0215403 A1 Aug. 26, 2010

(30) Foreign Application Priority Data

Feb. 25, 2009 (JP) ..... 2009-042736

(51) Int. Cl.
*G03G 15/08* (2006.01)
*G03G 21/18* (2006.01)

(52) U.S. Cl.
USPC ..... 399/102; 399/164; 399/114; 399/345

(58) Field of Classification Search
USPC ..... 399/108.11, 111, 114–117, 128, 399/159, 161, 168, 174, 345, 347
See application file for complete search history.

(56) References Cited

U.S. PATENT DOCUMENTS 6,009,287 A * 12/1999 Goldie ..... 399/103
6,088,552 A * 7/2000 Morinaga et al. ..... 399/106
6,317,573 B1 * 11/2001 Baker et al. ..... 399/114
2007/0025767 A1 * 2/2007 Motomura ..... 399/159
2008/0038010 A1 2/2008 Ichikawa et al.

FOREIGN PATENT DOCUMENTS

JP 5-257412 10/1993
JP 8-110744 4/1996
JP 2006-163203 6/2006
JP 2008-040336 2/2008

OTHER PUBLICATIONS

Office Action in KR 10-2009-0085888 dated Oct. 22, 2012.
English Translation of Office Action in KR 10-2009-0085888 dated Oct. 22, 2012.
English Abstract of JP 2008-040336. dated: Feb. 21, 2008.
English Translation of JP 2006-163203. dated: Jun. 22, 2006.

* cited by examiner

*Primary Examiner* — Walter L Lindsay, Jr.
*Assistant Examiner* — Jessica L Eley
(74) *Attorney, Agent, or Firm* — Fildes & Outland, P.C.

(57) ABSTRACT

An aspect of the present invention is a protective sheet including: a protective portion that can be inserted between a charging member which is in contact with an outer peripheral surface of a latent image carrier and the latent image carrier, and that can cover an image forming area formed on the outer peripheral surface of the latent image carrier; and a high friction portion that is connected to an end portion of the protective portion, that can be inserted between a pressing portion for being pressed against a background area formed on the outer peripheral surface of the latent image carrier and the background area of the latent image carrier, and whose dynamic frictional force when pulled out from the latent image carrier is higher than that of the protective portion.

19 Claims, 13 Drawing Sheets

PROTECTIVE SHEET, IMAGE FORMING UNIT AND IMAGE FORMING APPARATUS

CROSS-REFERENCE TO RELATED APPLICATION

This application is based on and claims priority under 35 USC 119 from Japanese Patent Application No. 2009-042736 filed Feb. 25, 2009.

BACKGROUND

Technical Field

The present invention relates to a protective sheet, an image forming unit and an image forming apparatus.

SUMMARY

A protective sheet of an aspect of the invention includes: a protective portion that can be inserted between a charging member which is in contact with an outer peripheral surface of a latent image carrier and the latent image carrier, and that can cover an image forming area formed on the outer peripheral surface of the latent image carrier; and a high friction portion that is connected to an end portion of the protective portion, that can be inserted between a pressing portion for being pressed against a background area formed on the outer peripheral surface of the latent image carrier and the background area of the latent image carrier, and whose dynamic frictional force when pulled out from the latent image carrier is higher than that of the protective portion.

BRIEF DESCRIPTION OF THE DRAWINGS

An exemplary embodiment of the invention will be described in detail with reference to the following figures, wherein.

DETAILED DESCRIPTION

One example of an exemplary embodiment of the present invention is described below with reference to the drawings.

Configuration of Image Forming Unit according to the Exemplary Embodiment

Figure 1:
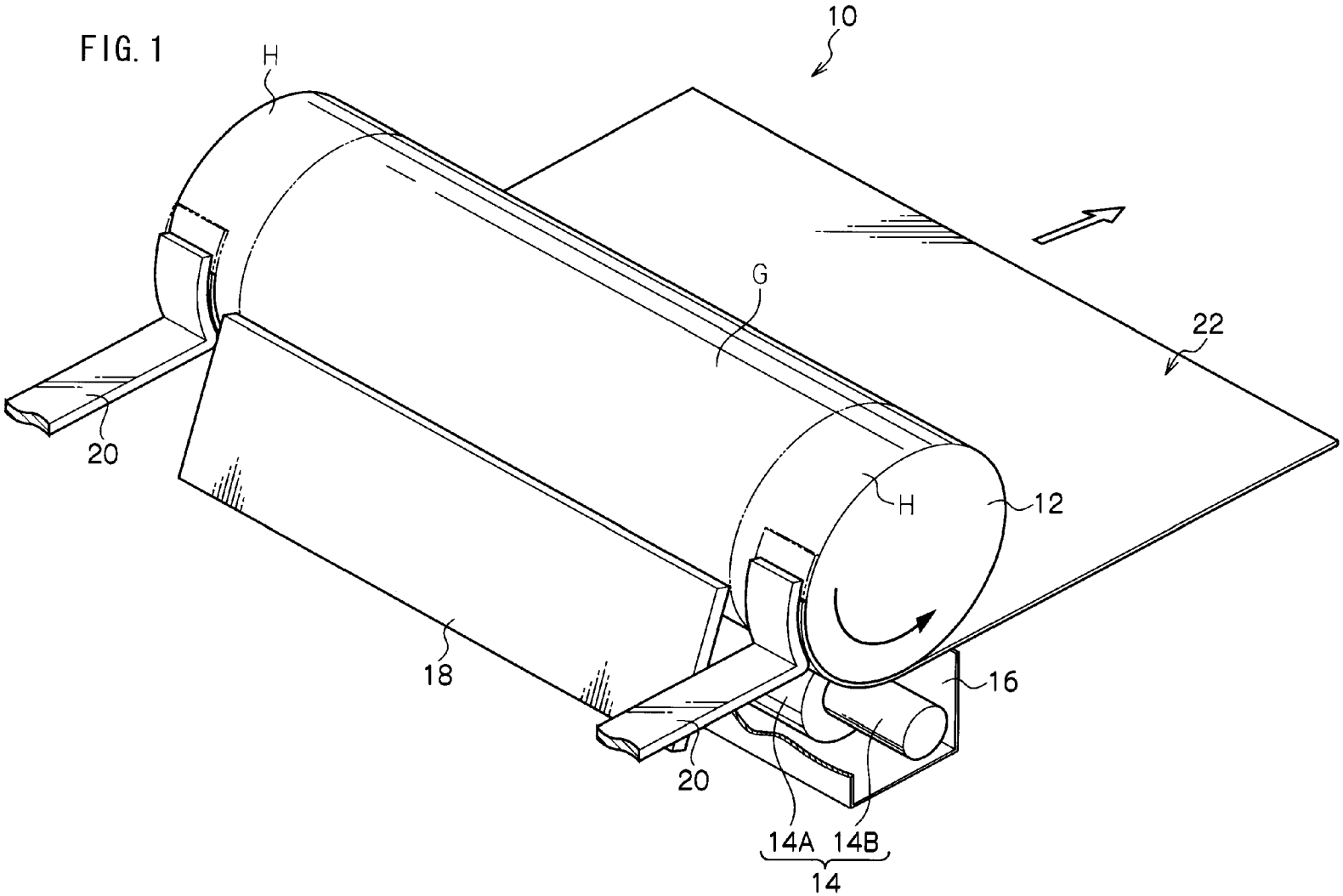
FIG. 1 is a schematic perspective view illustrating a configuration of an image forming unit according to an exemplary embodiment.

A configuration of an image forming unit according to the exemplary embodiment is described. FIG. 1 is a schematic perspective view illustrating the configuration of the image forming unit according to the exemplary embodiment.

The image forming unit 10 according to the exemplary embodiment includes a photosensitive drum 12 as one example of a latent image carrier which holds a latent image thereon as shown in FIG. 1. The photosensitive drum 12 is supported rotatably by a supporting portion which is not shown in the drawings. An outer peripheral surface of the photosensitive drum 12 is formed with an image forming area G on which an image (toner image) is formed, and a background area H on which an image (toner image) is not formed. The image forming area G is formed on a center portion of the photosensitive drum 12 in an axial direction, and the background area H is formed on both ends of the photosensitive drum 12 in the axial direction.

The latent image carrier is not limited to the photosensitive drum, and a photosensitive belt formed into a belt shape may be used as long as it holds a latent image.

A charging roll 14 as one example of a charging member capable of charging the outer peripheral surface of the photosensitive drum 12 is provided below the photosensitive drum 12 with it in contact with the outer peripheral surface of the photosensitive drum 12. The charging roll 14 is housed in a housing frame 16 as one example of a housing portion. The charging roll 14 is supported rotatably by a bearing member (not shown in the drawings) supported by a pressurizing member at the housing frame 16.

The charging roll 14 includes a roll section 14A which comes in contact with the image forming area G of the photosensitive drum 12 so as to charge the image forming area G, and a shaft section 14B which is arranged on both ends of the roll section 14A in the axial direction and whose diameter is smaller than that of the roll section 14A. The roll section 14A is pressurized against the photosensitive drum 12 by a pressurizing unit which is not shown in the drawings. The shaft section 14B is arranged at the background area H of the photosensitive drum 12 and does not come in contact with the photosensitive drum 12.

The charging member is not limited to the charging roll, and a charging belt formed into a belt shape may be used as long as it charges the latent image carrier.

Figure 6:
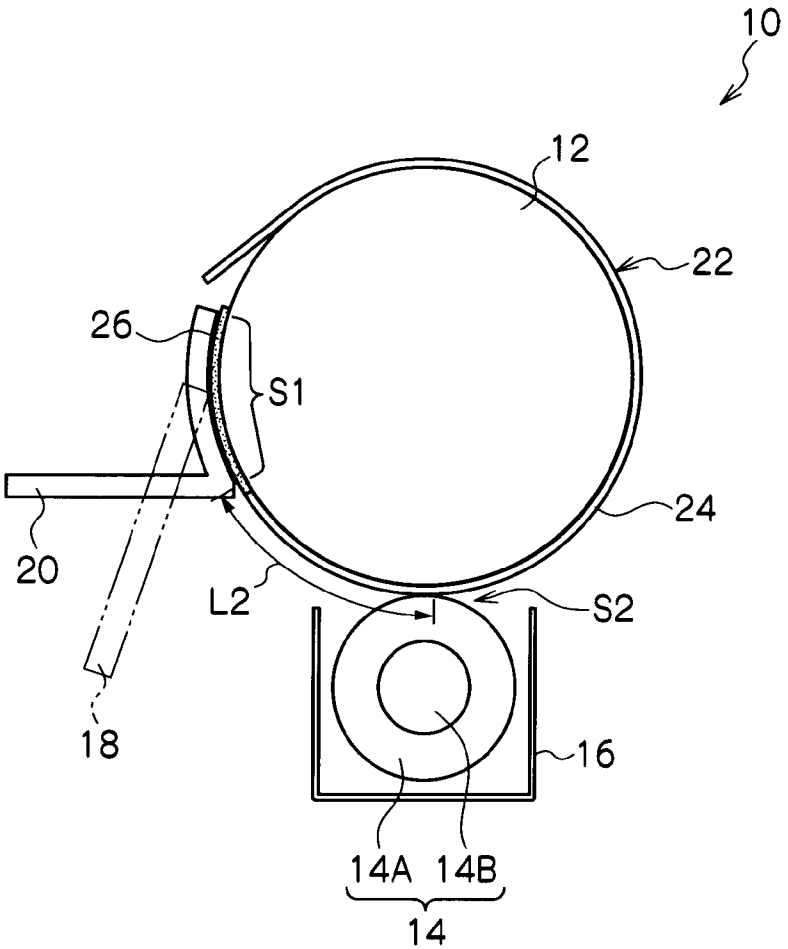
FIG. 6 is a schematic diagram illustrating a state that the protective sheet coats an exposed portion of a photosensitive drum according to the exemplary embodiment.

A cleaning blade 18 as one example of a removing member is provided at a side of the photosensitive drum 12 (in FIG. 6, at left side). The cleaning blade 18 comes in contact with the image forming area G of the photosensitive drum 12 to remove toner adhering to the photosensitive drum 12. The cleaning blade 18 scrapes off the toner adhering to the photosensitive drum 12 so as to remove the toner.

A side seal 20 as one example of a pressing portion is provided at both sides of the cleaning blade 18 in a widthwise direction of the cleaning blade 18 such that the side seals 20 sandwich the cleaning blade 18. The side seals 20 are pressed against the background area H of the photosensitive drum 12. The side seals 20 suppress leakage of the toner scraped off by the cleaning blade 18 from the both sides of the cleaning blade 18 in the widthwise direction.

In the image forming unit 10 according to the exemplary embodiment, a protective sheet 22, which will be described later, is attached onto the outer peripheral surface of the photosensitive drum 12 in a factory delivered state, namely, an non-used state (see FIG. 6). The image forming unit 10 is used after the attached protective sheet 22 is detached therefrom.

Configuration of the Protective Sheet according to the Exemplary Embodiment

Figure 2:
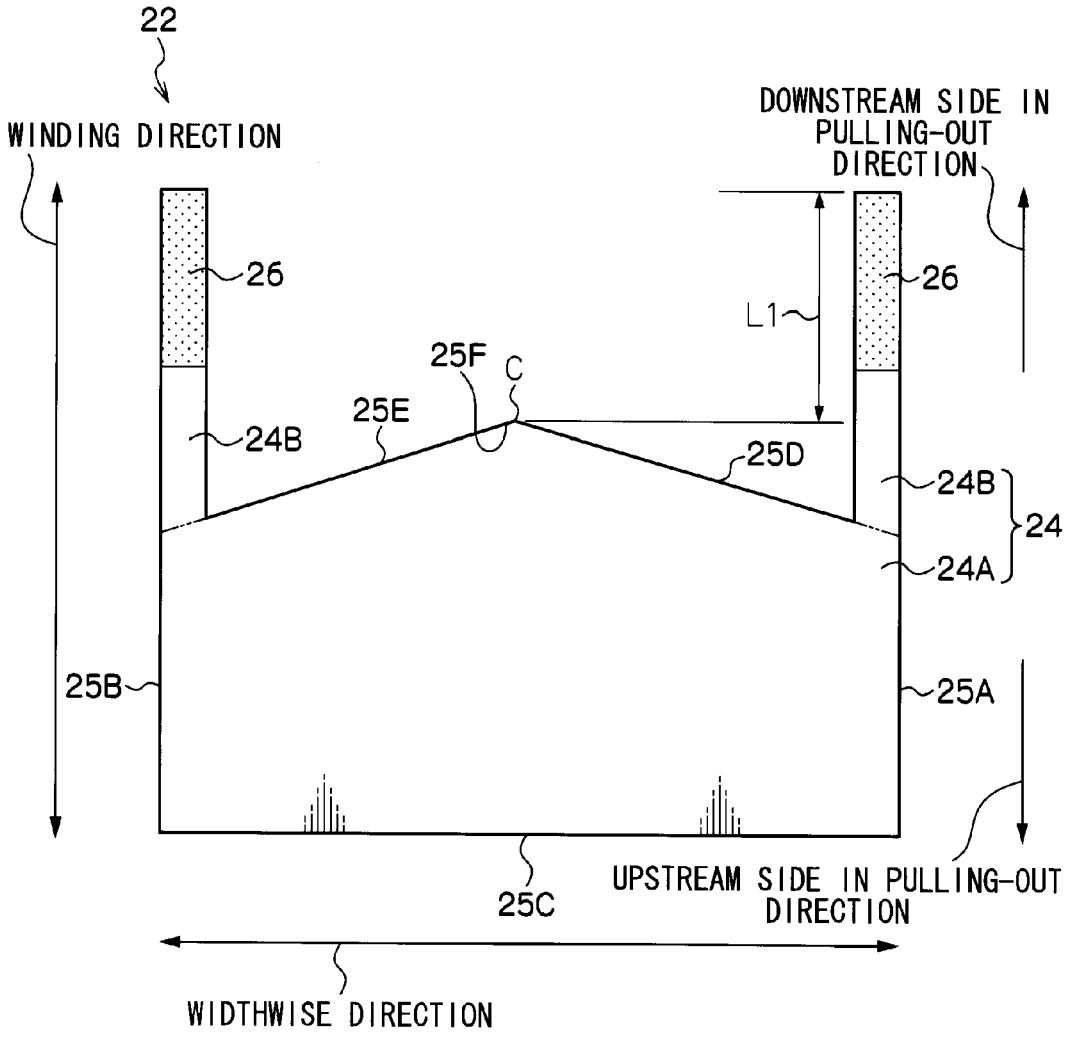
FIG. 2 is a schematic diagram illustrating a configuration of a protective sheet according to the exemplary embodiment.

A configuration of the protective sheet according to the exemplary embodiment is described below. FIG. 2 is a schematic diagram illustrating the configuration of the protective sheet according to the exemplary embodiment.

The protective sheet 22 according to the exemplary embodiment can be attached to the photosensitive drum 12 of the image forming unit 10, and is used for protecting the image forming area G of the photosensitive drum 12. The protective sheet 22 can be curved, and is wound around to cover the outer peripheral surface of the photosensitive drum 12 (see FIG. 6).

In the following description, when the protective sheet 22 is wound around the photosensitive drum 12, a direction along the axial direction of the photosensitive drum 12 is a widthwise direction of the protective sheet 22, and a direction along the peripheral direction of the photosensitive drum 12 is a winding direction of the protective sheet 22. The winding direction is also a pulling out direction where the protective sheet 22 wound around the photosensitive drum 12 is pulled out.

The protective sheet 22 includes as shown in FIG. 2 a protective portion 24 capable of covering the image forming area G of the photosensitive drum 12, and high friction portions 26 whose dynamic frictional force at the time of pulling out of the photosensitive drum 12 is higher than that of the protective portion 24.

The protective portion 24 can be inserted between the charging roll 14 and the photosensitive drum 12. The protective portion 24 has a black color for absorbing light in order to suppress exposure onto the photosensitive drum 12.

The protective portion 24 includes a protective portion main body 24A for covering the image forming area G of the photosensitive drum 12, and connecting portions 24B for connecting the protective portion main body 24A and the high friction portions 26.

A widthwise length of the protective portion main body 24A is set to be longer than an axial length of the image forming area G of the photosensitive drum 12, so the protective portion main body 24A has a size such that it can cover an axial entire area of the image forming area G of the photosensitive drum 12.

A length of the winding direction of the protective portion main body 24A is set to be longer than a length of an exposed portion of the image forming area G of the photosensitive drum 12 in the peripheral direction. The protective portion main body 24A has a size such that it can cover an entire area of the exposed portion of the image forming area G of the photosensitive drum 12 in the peripheral direction.

Note that the exposed portion is a portion exposed to the outside of the image forming unit 10, and is a portion where exposure is done when light is emitted from the outside of the image forming unit 10. The length of the protective portion main body 24A in the winding direction may be a length capable of covering the entire periphery of the image forming area G of the photosensitive drum 12, but is at least a length capable of covering the entire area of the exposed portion of the image forming area G of the photosensitive drum 12 in the peripheral direction.

In the protective portion main body 24A, sides 25A and 25B on both ends of the widthwise direction are formed into a linear shape. The sides 25A and 25B extend parallel.

Further, in the protective portion main body 24A, a side 25C at one end of the winding direction is formed into a linear shape. The side 25C is a side at an upstream side of the pulling out direction of the protective sheet 22.

The protective portion main body 24A can cover the photosensitive drum 12 so that its covering width, at an end (at the other end in the winding direction), that covers the image forming area G of the photosensitive drum 12 becomes narrower towards one direction in the peripheral direction of the photosensitive drum 12.

Concretely, the further downstream side in the pulling out direction "the end portion at the downstream side of the pulling out direction" is, the narrower the covering width that covers the image forming area G of the photosensitive drum 12 becomes.

More concretely, the other end in the winding direction of the protective portion main body 24A is formed by an oblique side 25D and an oblique side 25E. The oblique side 25D extends from an apex C at a center portion in the widthwise direction to the side 25A, and tilts towards the side 25C, and the oblique side 25E extends from the apex C at the center portion in the widthwise direction to the side 25B, and tilts towards the side 25C. The oblique sides 25D and 25E form a corner portion 25F where the center portion in the widthwise direction protrudes outward.

That is, the other end portion of the protective portion main body 24A in the winding direction (the end portion at the downstream side of the pulling out direction) is formed in the shape such that, as the protective portion main body 24A is pulled out between the photosensitive drum 12 and the charging roll 14 along the peripheral direction of the photosensitive drum 12, a contact width between the photosensitive drum 12 and the charging roll 14 becomes wider. In the shape shown in FIG. 2, the photosensitive drum 12 and the charging roll 14 start to contact at both axial end portions and the contact width gradually increases from the axial both end portions toward the center portion.

Figure 3:
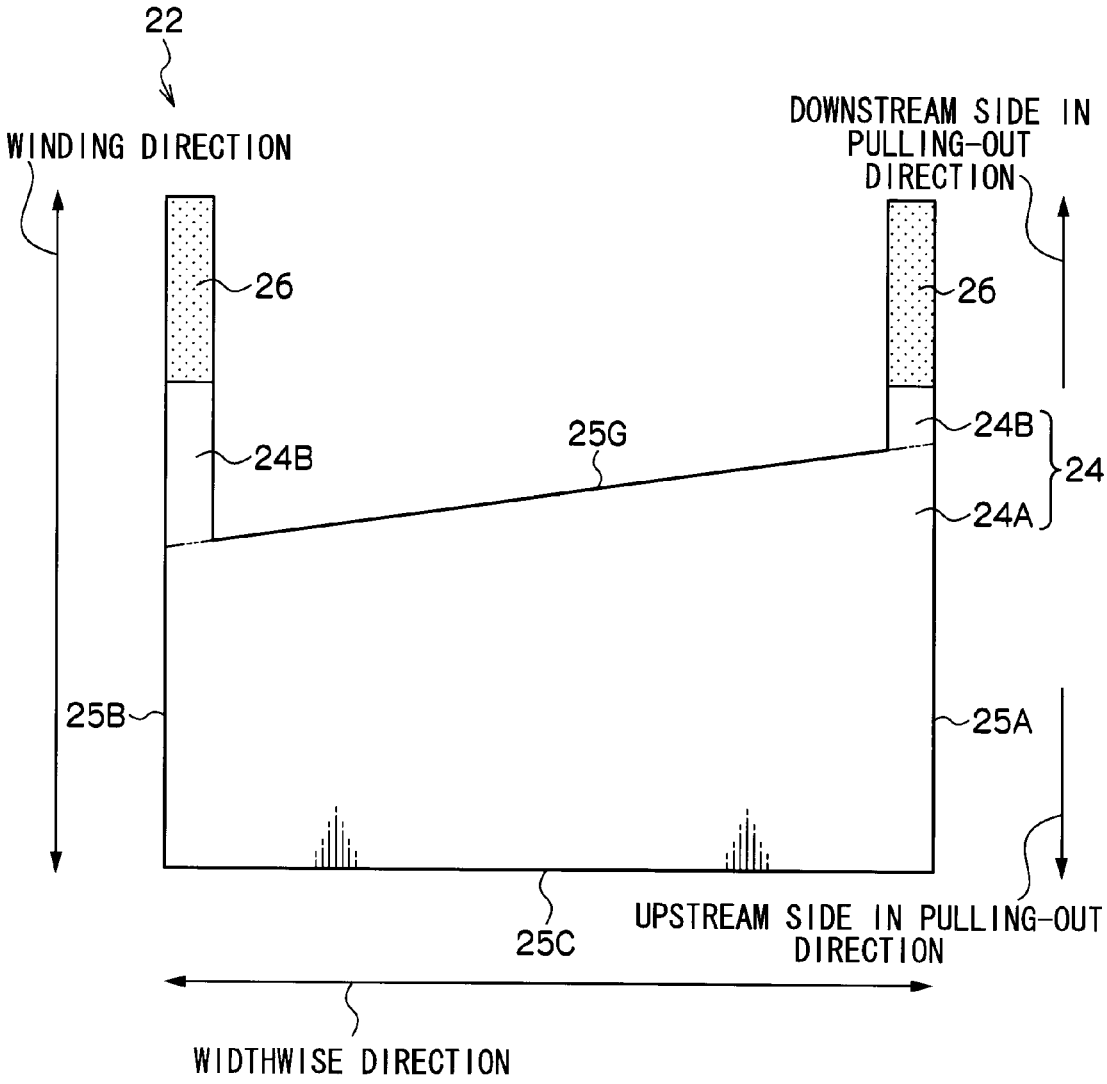
FIG. 3 is a schematic diagram illustrating a modified example where a shape of an end portion of a protective portion main body on a lower-stream side in a pulling out direction is changed according to the exemplary embodiment.

The shape of the end portion of the protective portion main body 24A at the downstream side of the pulling out direction may be a shape shown in FIG. 3. In this configuration, the other end portion of the protective portion main body 24A in the winding direction is formed by an oblique side 25G which extends from the side 25A to the side 25B and which tilts towards the side 25C. In the shape shown in FIG. 3, the photosensitive drum 12 and the charging roll 14 start to contact at the axial one end portion and the contact width gradually increases from the axial one end portion toward the other end portion.

Figure 4:
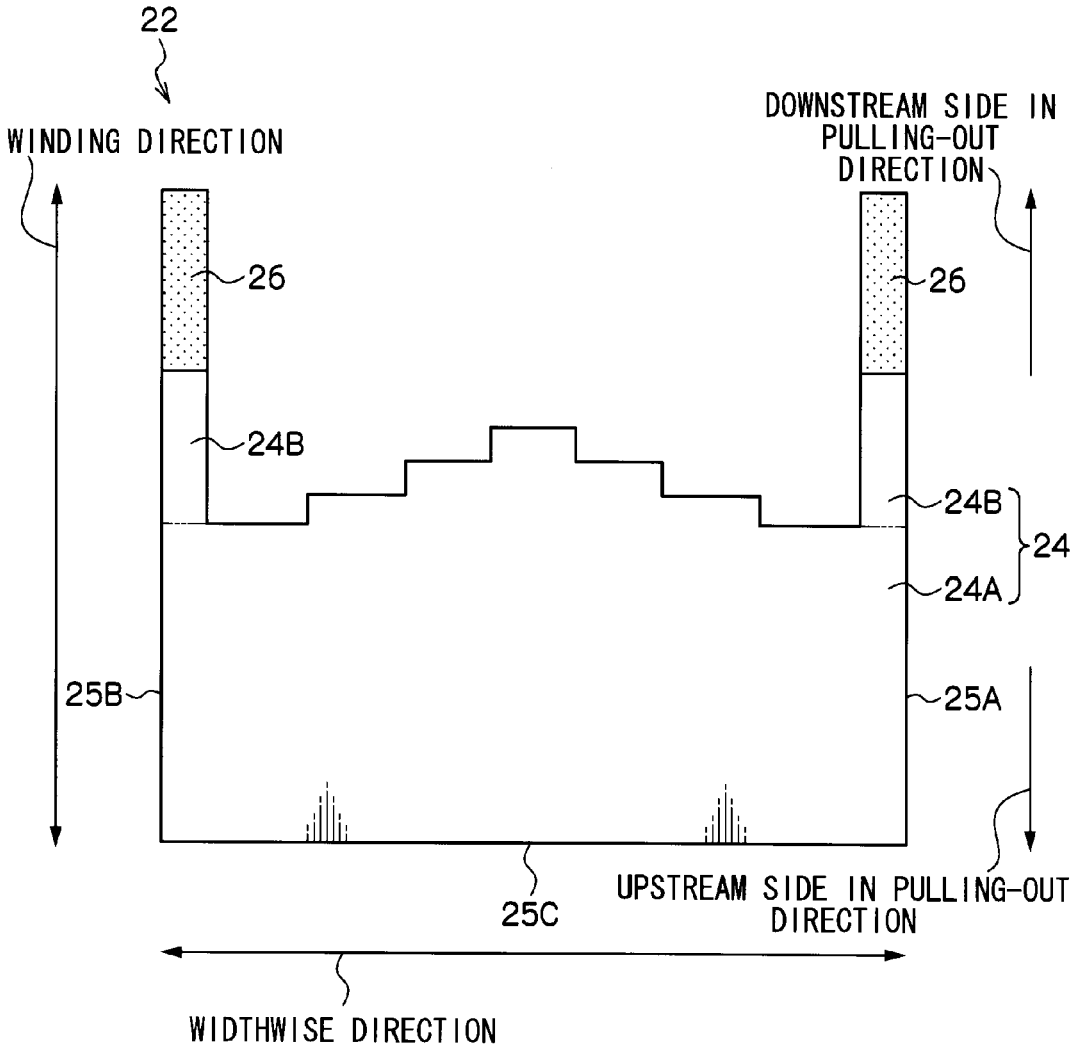
FIG. 4 is a schematic diagram illustrating a modified example where the end portion of the protective portion main body on the lower-stream side in the pulling out direction is changed according to the exemplary embodiment.

As shown in FIG. 4, the protective portion main body 24A may be formed such that the end portion at the downstream side of the pulling out direction has a stepped shape, and the further downstream side in the pulling out direction "the end portion at the downstream side of the pulling out direction" is, the narrower the covering width for the photosensitive drum 12 becomes.

Figure 5:
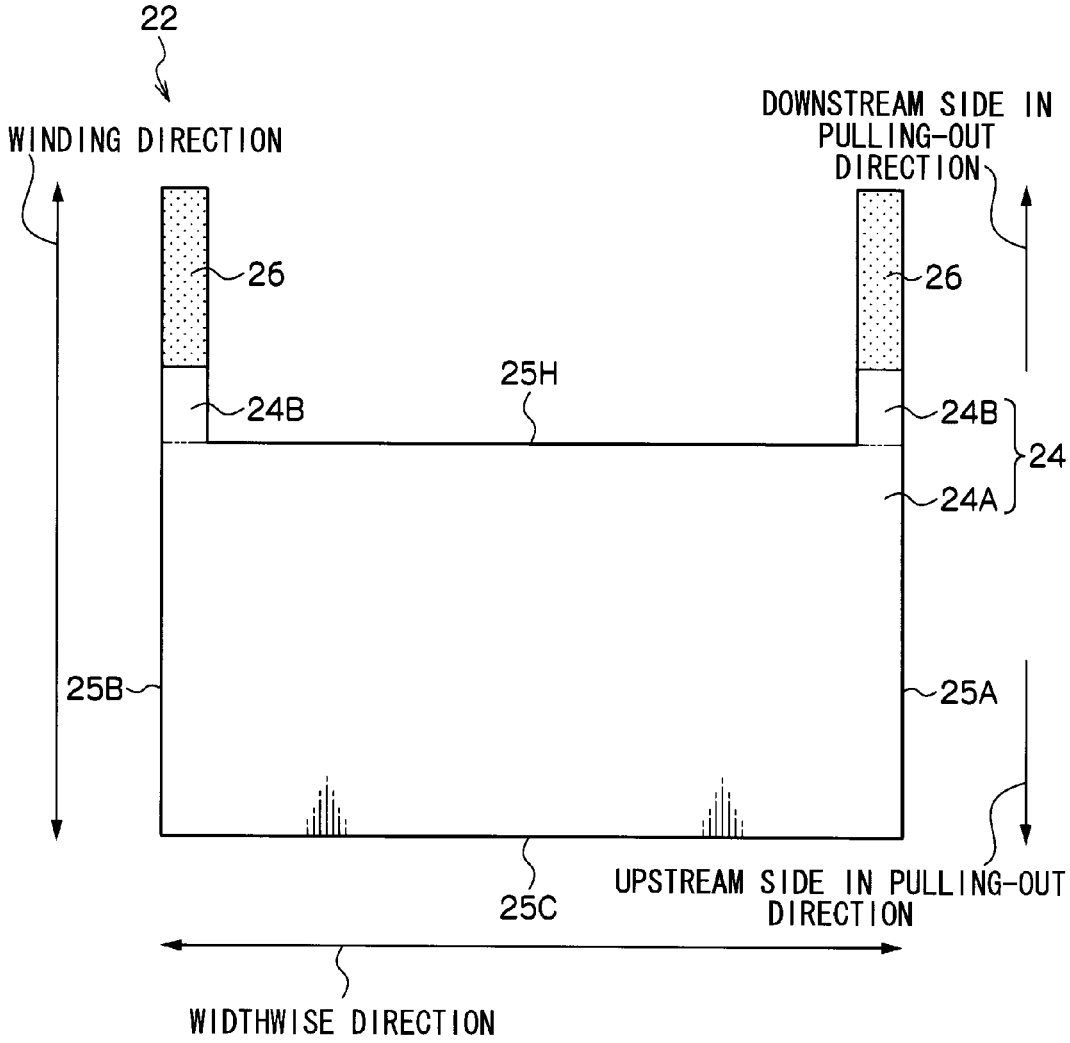
FIG. 5 is a schematic diagram illustrating a modified example where the end portion of the protective portion main body on the lower-stream side in the pulling out direction is changed according to the exemplary embodiment.

As shown in FIG. 5, the protective portion main body 24A may be formed such that the end portion at the downstream side of the pulling out direction is a linear side 25H along the widthwise direction. This side 25H extends parallel with the side 25C.

The connecting portions 24B of the protective portion 24 each extends from the other end of the protective portion main body 24A in the winding direction toward the downstream side of the pulling out direction. When the protective sheet 22 is wound around the photosensitive drum 12, the connecting portions 24B are arranged on the background areas H of the photosensitive drum 12.

The high friction portions 26 are provided integrally with the respective connecting portions 24B of the protective portion 24, and are connected to the end portions of the connecting portions 24B at the downstream side of the pulling out direction. The high friction portion 26 is formed by an elastic sheet such as rubber. For example, surface roughness of the high friction portion 26 is higher than that of the protective portion 24.

The high friction portions 26 can be inserted between the side seals 20 and the background areas H of the photosensitive drum 12. When the protective sheet 22 is wound around the photosensitive drum 12, the high friction portion 26 is arranged at a position where the high friction portion 26 is inserted between the side seal 20 and the background area H of the photosensitive drum 12 in a state that the protective portion 24 is inserted between the charging roll 14 and the photosensitive drum 12.

By the high friction portion 26 being inserted between the side seal 20 and the background area H of the photosensitive drum 12, the high friction portion 26 is pressed against the background area H of the photosensitive drum 12 by the side seal 20.

Figure 9A:
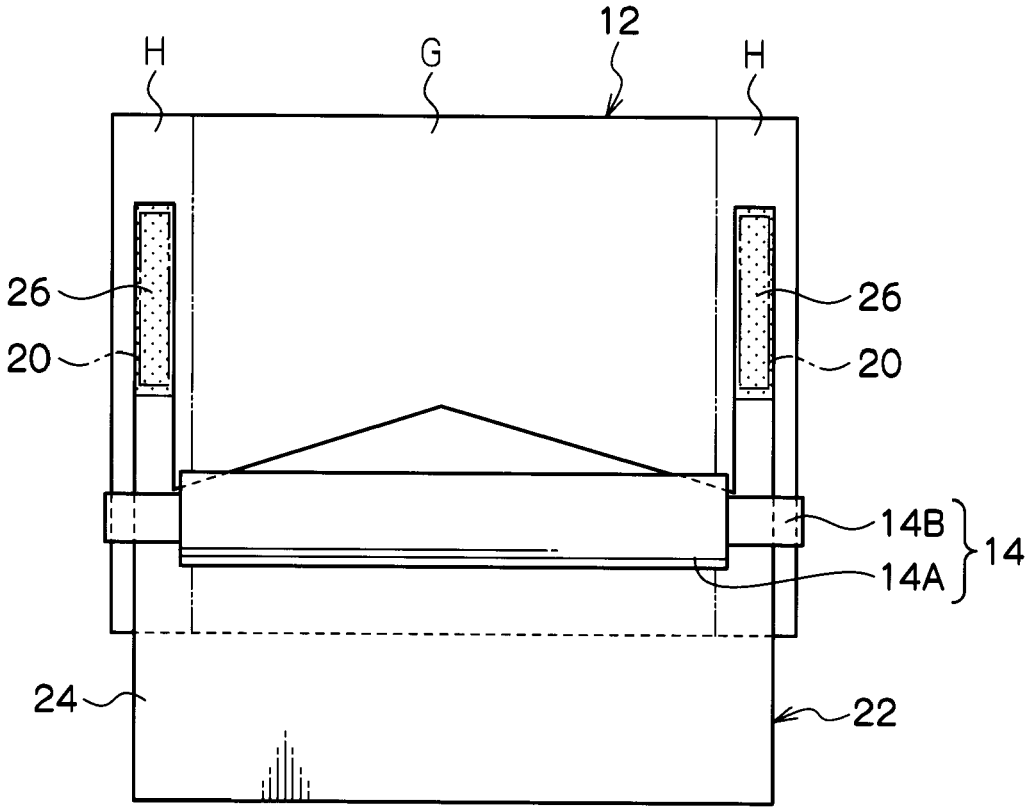
FIGS. 9A and 9B are development views illustrating a state that the protective sheet according to the exemplary embodiment is sandwiched between the photosensitive drum and a charging roll and a state that the protective sheet is sandwiched between the photosensitive drum and a side seal.
Figure 9B:
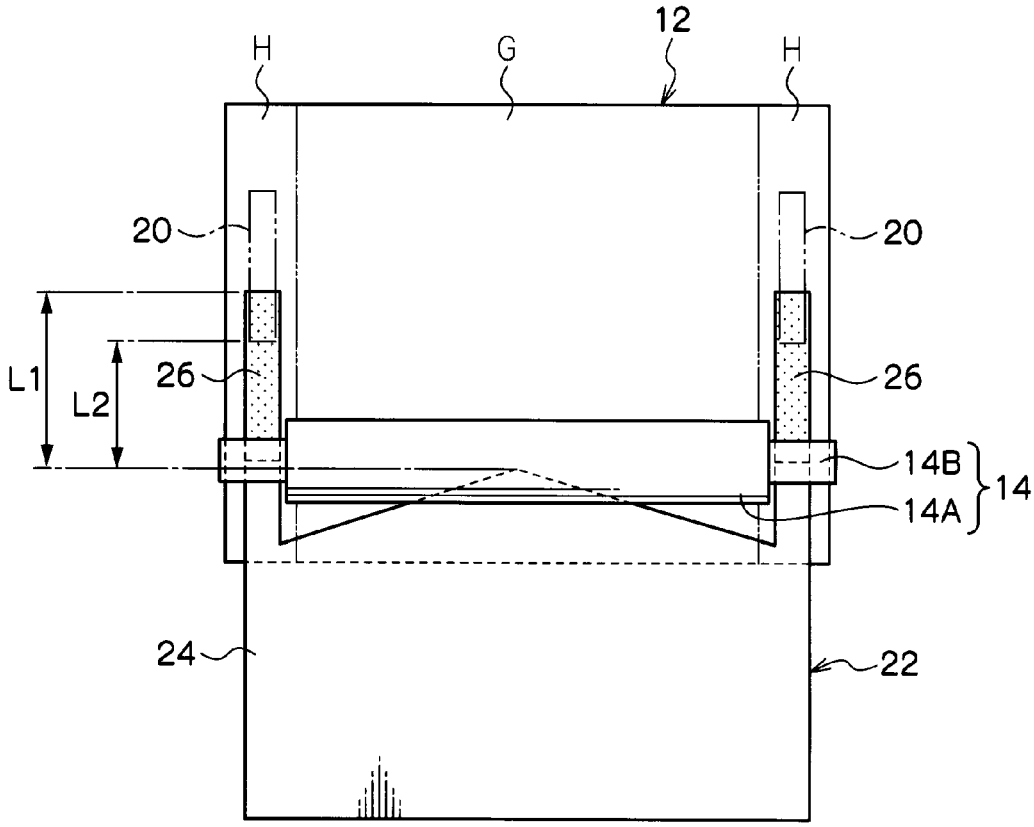

A length L1 in the pulling out direction from a downstream side end (for example, the apex C in FIG. 2) of the protective portion main body 24A in the pulling out direction to the downstream side end of the high friction portion 26 in the pulling out direction (see FIGS. 2 and 9A and 9B) is set to be longer than a peripheral length L2 from an upstream side end in the pulling out direction of a contact portion S2 between the photosensitive drum 12 and the charging roll 14 to an upstream side end in the pulling out direction of a contact portion S1 between the photosensitive drum 12 and the side seal 20 (see FIGS. 6 and 9A and 9B).

That is, even when the protective portion 24 has been pulled out from between the photosensitive drum 12 and the charging roll 14, at least a part of the high friction portion 26 is arranged on the insertion position where inserted between the side seal 20 and the background area H of the photosensitive drum 12.

That is, at the time of the apex C passing through between the photosensitive drum 12 and the charging roll 14, at least a part of the high friction portion 26 is still inserted (present) between the side seal 20 and the background area H of the photosensitive drum 12.

The high friction portions 26 are arranged on positions corresponding to positions at the outer sides of the axial width of the roll section 14A, and each is positioned at the outer side with respect to an extended line of a boundary between the roll section 14A and the axial section 14B.

That is, when the protective sheet 22 is pulled out along the peripheral direction of the photosensitive drum 12, each of the high friction portions 26 is arranged on a position between the axial section 14B and the photosensitive drum 12 where it passes.

Operation of the Image Forming Unit according to the Exemplary Embodiment

An operation of the image forming unit according to the exemplary embodiment is described below.

Figure 7:
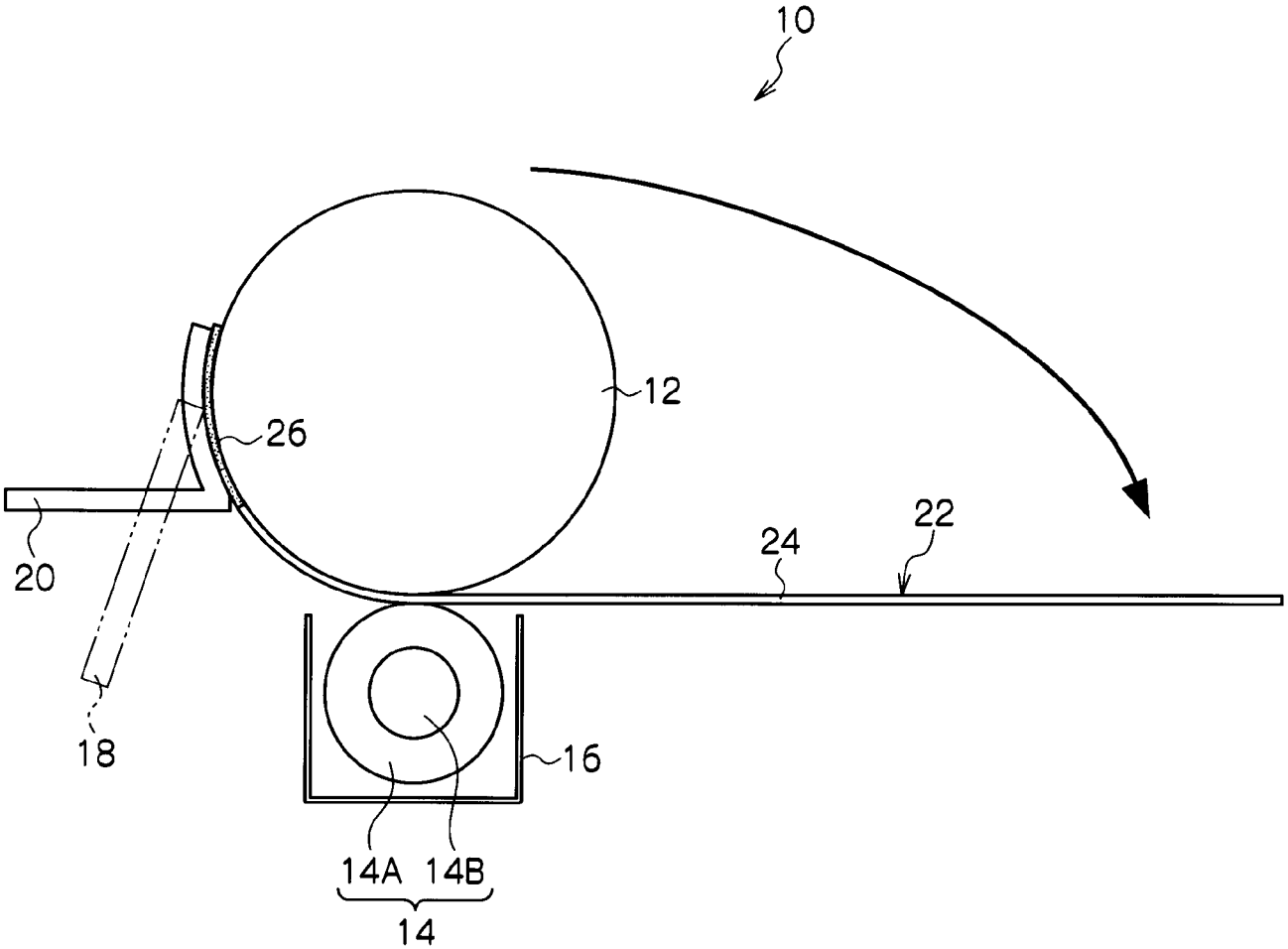
FIG. 7 is a schematic diagram illustrating a state that the protective sheet is removed from the exposed portion of the photosensitive drum according to the exemplary embodiment.

The image forming unit 10 to which the protective sheet 22 is attached is set so that the protective sheet 22 covers the exposed portion of the photosensitive drum 12 as shown in FIG. 6. The protective sheet 22 is removed from the exposed portion of the photosensitive drum 12 as shown in FIG. 7. In this state, the protective sheet 22 is provided so that the protective portion 24 is sandwiched between the charging roll 14 and the photosensitive drum 12 and the high friction portions 26 are sandwiched between the photosensitive drum 12 and the side seals 20 as shown in FIG. 9A.

Figure 8:
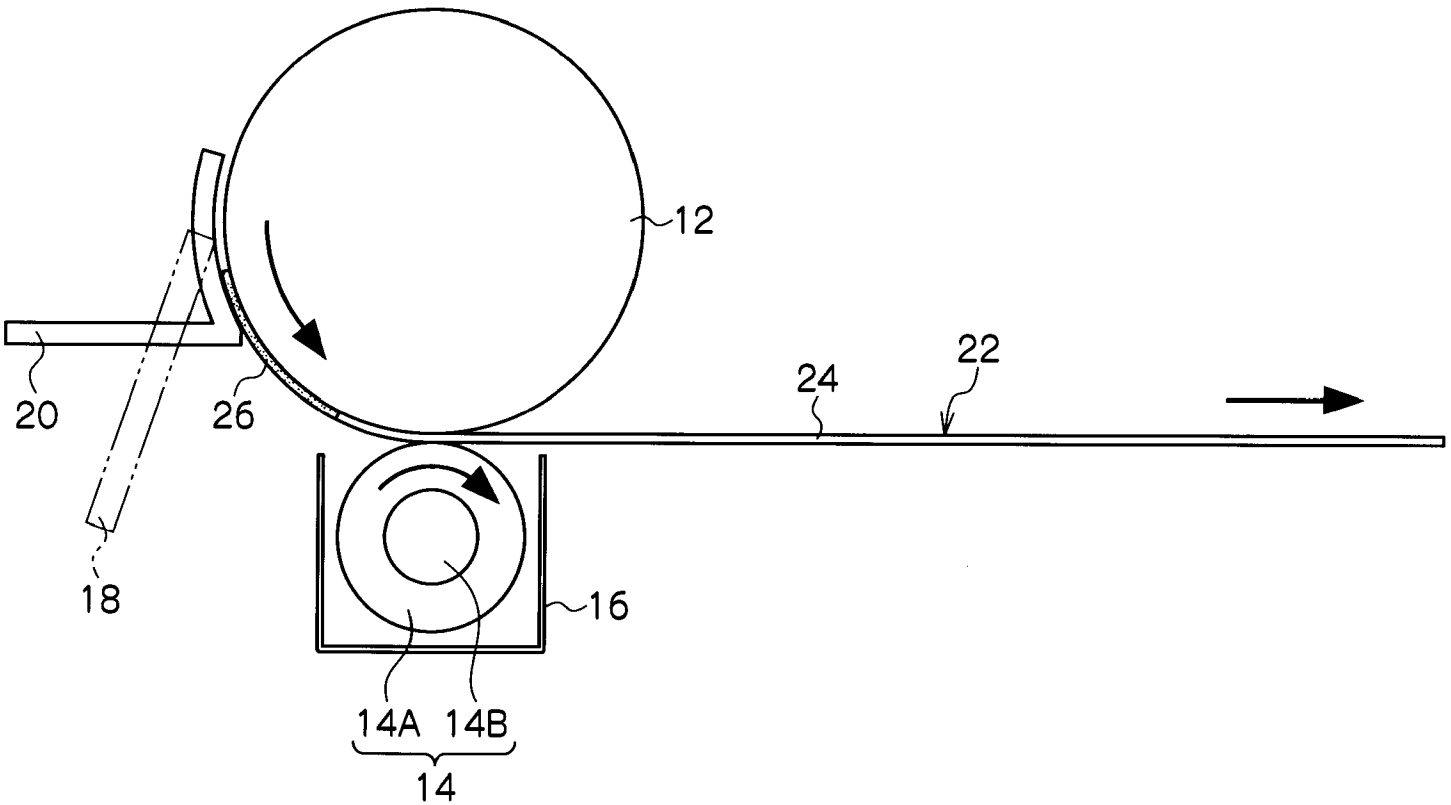
FIG. 8 is a schematic diagram illustrating a state that the protective sheet is pulled out according to the exemplary embodiment.

The sandwiched protective sheet 22 in this manner is pulled out along the peripheral direction of the photosensitive drum 12 as shown in FIG. 8, then, the image forming unit 10 is used.

When the protective sheet 22 is being pulled out, the charging roll 14 pressurized against the photosensitive drum 12 is driven according to movement of the protective portion 24 of the protective sheet 22.

On the other hand, frictional resistance force due to the contact with the cleaning blade 18 is applied to the photosensitive drum 12, however, the photosensitive drum 12 is driven according to movement of the high friction portions 26 pressurized by the side seals 20.

As the protective sheet 22 is further being pulled out and the protective portion 24 is being pulled out between the photosensitive drum 12 and the charging roll 14, the contact width between the photosensitive drum 12 and the charging roll 14 become wider.

As a result, since the charging roll 14 and the photosensitive drum 12 start to rotate gradually in interlocking manner, accordingly, when the protective portion 24 is completely pulled out between the charging roll 14 and the photosensitive drum 12, the photosensitive drum 12 and the charging roll 14 are rotated in interlocking manner.

Also, when the protective portion 24 is pulled out between the charging roll 14 and the photosensitive drum 12, as shown in FIG. 9B, the photosensitive drum 12 is driven to be rotated by the high friction portions 26 which are inserted between the side seals 20 and the background areas H of the photosensitive drum 12.

When the protective sheet 22 is being pulled out, the high friction portions 26 pass through between the axial section 14B of the charging roll 14 and the photosensitive drum 12.

As mentioned above, due to motion of the protective sheet 22, photosensitive drum 12 and the charging roll 14, occurring of a speed difference among the protective sheet 22, the photosensitive drum 12 and the charging roll 14 is suppressed.

In the image forming unit 10, the side seal 20 is used as the pressing portion, however, the pressing portion is not limited to the same, and various members may be used. The pressing portion may be disposed on any position on the outer periphery of the photosensitive drum 12.

The arrangement position of the protective sheet 22 is set on the basis of the position of the pressing portion. That is, when the protective sheet 22 is wound around the photosensitive drum 12, in a state where the protective portion 24 is inserted between the charging roll 14 and the photosensitive drum 12, the high friction portion 26 is arranged on the position where the high friction portion 26 is inserted between the side seal 20 and the background area H of the photosensitive drum 12. Further, even when the protective portion 24 has been pulled out from between the photosensitive drum 12 and the charging roll 14, at least a part of the high friction portion 26 may be arranged on the insertion position where the high friction portion 26 is inserted between the side seal 20 and the background area H of the photosensitive drum 12.

Figure 10:
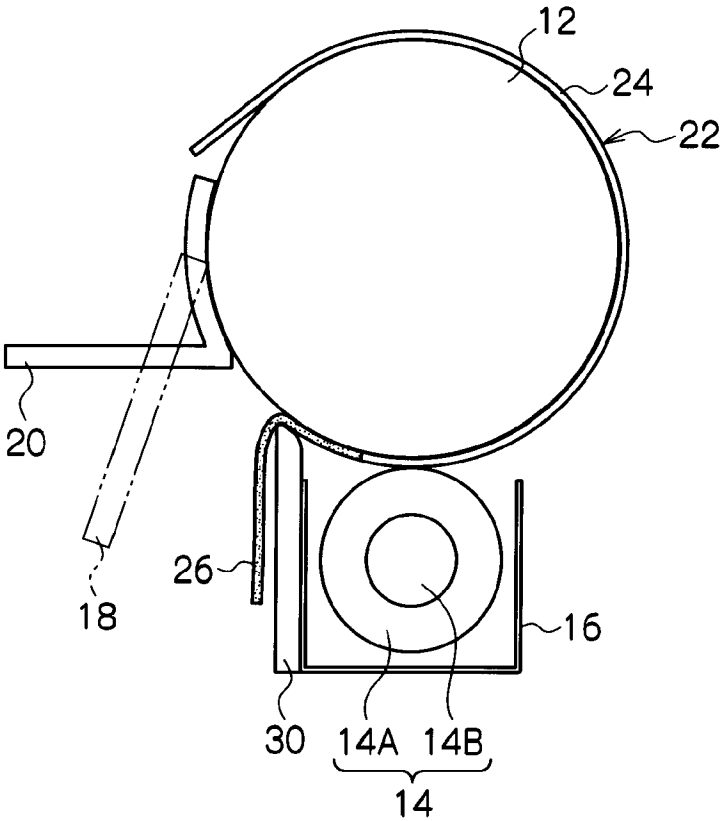
FIG. 10 is a schematic diagram illustrating a state that the protective sheet coats the exposed portion of the photosensitive drum in a configuration where a pressing member is used as a pressing portion.

As shown in FIG. 10, pressing members 30 provided at the housing frame 16 which houses the charging roll 14 may be used as the pressing portion.

The pressing member 30 is arranged at the downstream side in the pulling out direction of the protective sheet 22 with respect to the charging roll 14. Note that the side seal 20 is also arranged at the downstream side in the pulling out direction of the protective sheet 22 with respect to the charging roll 14, but the pressing member 30 is arranged at a position closer to the charging roll 14 compared with a position arranged at the side seal 20.

The pressing member 30 is pressurized and pressed against the photosensitive drum 12 by a pressurizing unit which is not shown in the drawings. At the protective sheet 22 attached to the photosensitive drum 12, the protective portion 24 is inserted between the charging roll 14 and the photosensitive drum 12 and covers the image forming area G of the photosensitive drum 12, and the high friction portion 26 is inserted between the pressing member 30 and the background area H of the photosensitive drum 12. The high friction portion 26 of the protective sheet 22 hangs from the pressing member 30.

Figure 11:
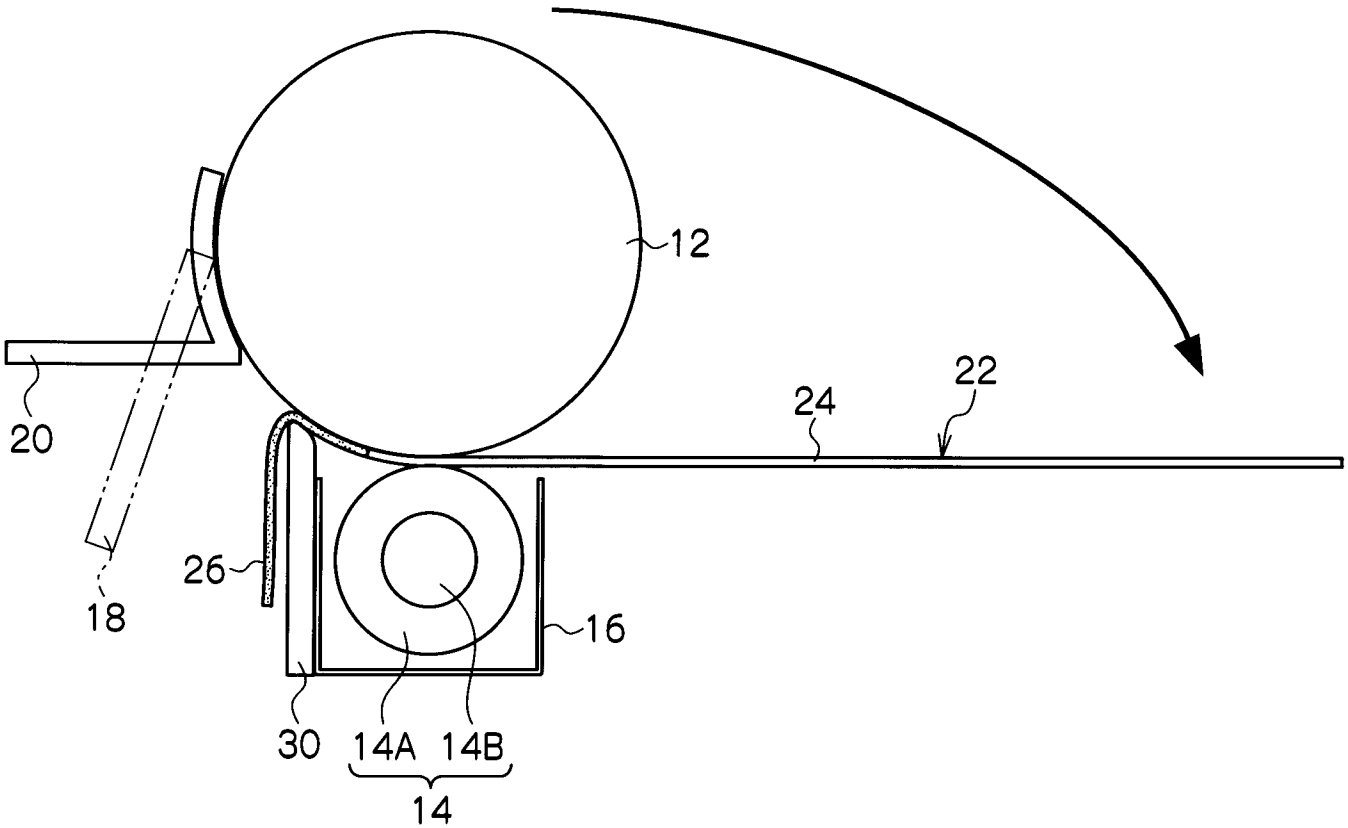
FIG. 11 is a schematic diagram illustrating a state that the protective sheet is removed from the exposed portion of the photosensitive drum in the configuration where the pressing member is used as the pressing portion.

In this configuration, the protective sheet 22 is removed from the exposed portion of the photosensitive drum 12 as shown in FIG. 11. In this state, the protective portion 24 of the protective sheet 22 is sandwiched between the charging roll 14 and the photosensitive drum 12, and the high friction portions 26 are sandwiched between the photosensitive drum 12 and the pressing members 30.

Figure 12:
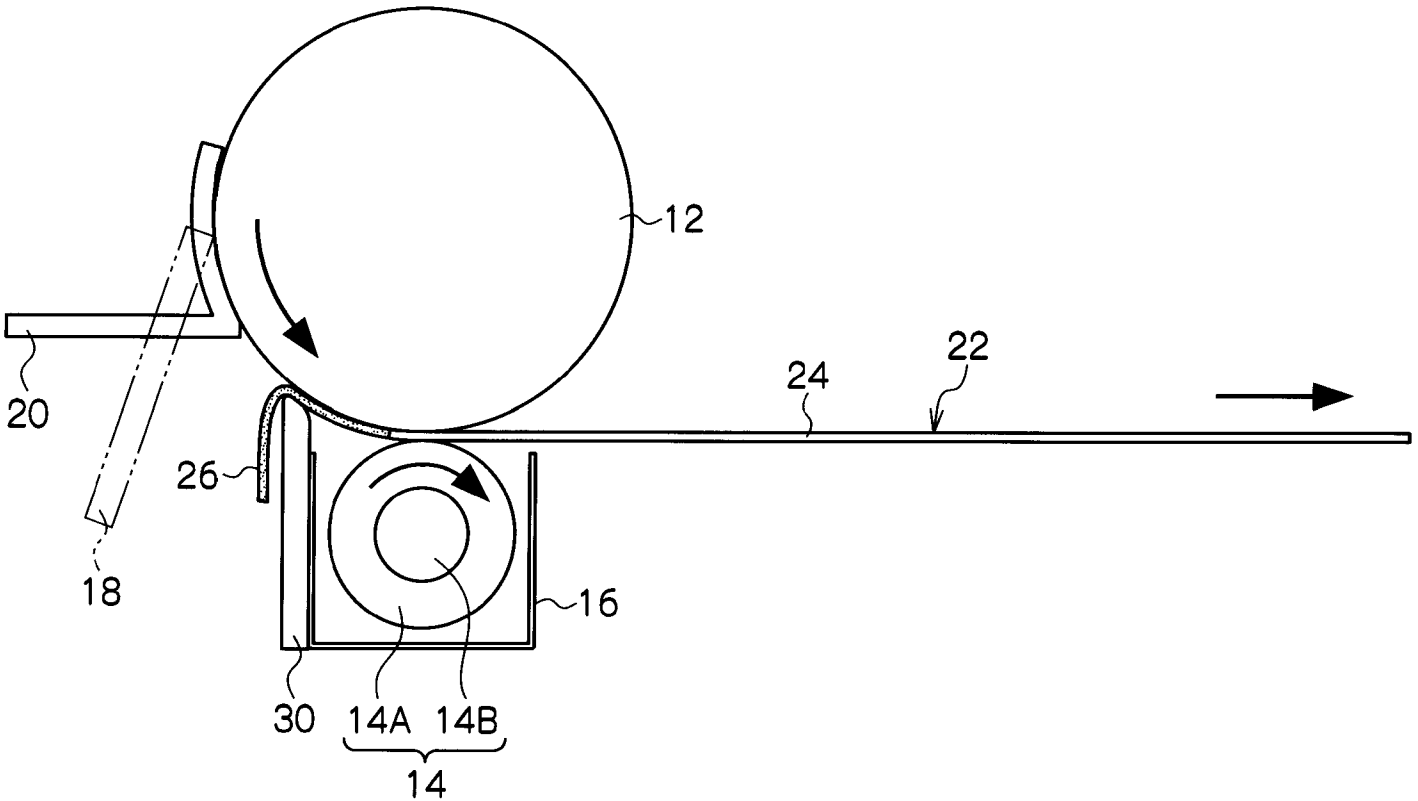
FIG. 12 is a schematic diagram illustrating a state that the protective sheet is pulled out in the configuration where the pressing member is used as the pressing portion.

The sandwiched protective sheet 22 in this manner is pulled out along the peripheral direction of the photosensitive drum 12 as shown in FIG. 12, then the image forming unit 10 is used.

When the protective sheet 22 is being pulled out, the charging roll 14 pressurized against the photosensitive drum 12 is driven according to the movement of the protective portion 24 of the protective sheet 22.

On the other hand, frictional resistance force due to the contact with the cleaning blade 18 is applied to the photosensitive drum 12, however, the photosensitive drum 12 is driven according to the movement of the high friction portions 26 pressed by the pressing members 30.

Further, when the protective portion 24 is pulled out between the charging roll 14 and the photosensitive drum 12, the photosensitive drum 12 is driven to be rotated by the high friction portions 26 which are inserted between the pressing members 30 and the image non-informing areas H of the photosensitive drum 12.

As mentioned above, due to motion of the protective sheet 22, photosensitive drum 12 and the charging roll 14, occurring of a speed difference among the protective sheet 22, the photosensitive drum 12 and the charging roll 14 is suppressed.

The invention is not limited to the above exemplary embodiment, and various modifications, changes and improvements may be made.

What is claimed is:

1. A protective sheet comprising:

a protective portion that is inserted between a charging member and a latent image carrier, the charging member being in contact with an outer peripheral surface of the latent image carrier, and the protective portion covering an image forming area formed on the outer peripheral surface of the latent image carrier; and an extended portion that is connected to an end portion of the protective portion in an axial direction of the latent image carrier and is extended in a peripheral direction of the latent image carrier, the extended portion having a high friction portion, the high friction portion being pressed by a presser toward an area on the outer peripheral surface, which is other than the image forming area, wherein a coefficient of friction of the high friction portion is higher than a coefficient of friction of the protective portion.

2. The protective sheet of claim 1, wherein the protective portion covers the latent image carrier such that, at the one end portion of the protective portion, a covering width that covers the image forming area of the latent image carrier becomes narrower towards one side in a direction corresponding to the peripheral direction of the latent image carrier.

3. The protective sheet of claim 1, wherein when the protective sheet is pulled out along the peripheral direction of the latent image carrier, the latent image carrier is rotated by friction force generated between the high friction portion and the latent image carrier.

4. An image forming unit comprising:

a latent image carrier having formed at an outer peripheral surface thereof an image forming area where an image is formed and an area which is other than the image forming area;

a charging member that comes in contact with the outer peripheral surface of the latent image carrier and that charges the outer peripheral surface of the latent image carrier;

a presser that is pressed against the area; and a protective sheet that is pulled out along a peripheral direction of the latent image carrier and that includes:

a protective portion that is inserted between the charging member and the latent image carrier, the charging member being in contact with the outer peripheral surface of the latent image carrier, and the protective portion covering the image forming area: and an extended portion that is connected to an end portion of the protective portion in an axial direction of the latent image carrier and is extended in the peripheral direction, the extended portion having a high friction portion, the high friction portion being pressed by the presser toward the area, wherein a coefficient of friction of the high friction portion is higher than a coefficient of friction of the protective portion.

5. The image forming unit of claim 4, wherein, at the end portion of the protective portion at a downstream side in a pulling out direction of the protective sheet, a covering width that covers the image forming area of the latent image carrier becomes narrower towards the downstream side in the pulling out direction.

6. The image forming unit of claim 5, wherein a length in the pulling out direction from an end at the downstream side in the pulling out direction of the protective portion to an end at the downstream side in the pulling out direction of the high friction portion is longer than a peripheral length from an end at an upstream side in the pulling out direction of a contact portion between the latent image carrier and the charging member to an end at the upstream side in the pulling out direction of a contact portion between the latent image carrier and the pressing portion.

7. The image forming unit of claini 5, wherein the charging member includes a roll section that contacts the latent image carrier, and axis sections that are provided at both ends of the roll section in an axis direction of the roll section, and the high friction portion is arranged at positions corresponding to positions at outer sides of both ends in the axis direction of the roll section respectively.

8. The image forming unit of claim 5, wherein a surface roughness of the high friction portion is higher than a surface roughness of the protective portion.

9. The image forming unit of claim 4, wherein the end portion of the protective portion at a downstream side in a pulling out direction of the protective sheet is formed with a shape such that, as the protective portion is pulled out from between the latent image carrier and the charging member along the peripheral direction of the latent image carrier, a contact width at which the latent image carrier and the charging member contact becomes wider.

10. The image forming unit of claim 4, wherein a length in the pulling out direction from an end at the downstream side in the pulling out direction of the protective portion to an end at the downstream side in the pulling out direction of the high friction portion is longer than a peripheral length from an end at an upstream side in the pulling out direction of a contact portion between the latent image carrier and the charging member to an end at the upstream side in the pulling out direction of a contact portion between the latent image carrier and the pressing portion.

11. The image forming unit of claim 10, wherein the charging member includes a roll section that contacts the latent image carrier, and axis sections that are provided at both ends of the roll section in an axis direction of the roll section, and the high friction portion is arranged at positions corresponding to positions at outer sides of both ends in the axis direction of the roll section respectively.

12. The image forming unit of claim 10, wherein a surface roughness of the high friction portion is higher than a surface roughness of the protective portion.

13. The image forming unit of claim 4, wherein the protective sheet is arranged on the image forming unit such that at least a part of the high friction portion is arranged between the presser and the area of the latent image carrier even when the protective portion has been pulled out from between the latent image carrier and the charging member.

14. The image forming unit of claim 4, wherein the charging member includes a roll section that contacts the latent image carrier, and axis sections that are provided at both ends of the roll section in an axis direction of the roll section, and the high friction portion is arranged at positions corresponding to positions at outer sides of both ends in the axis direction of the roll section respectively.

15. The image forming unit of claim 14, wherein a surface roughness of the high friction portion is higher than a surface roughness of the protective portion.

16. The image forming unit of claim 4, wherein the charging member includes a roll section that contacts the latent image carrier, and axis sections that are provided at both ends of the roll section in an axis direction of the roll section, and the high friction portion is arranged at positions where the high friction portion passes between the axis sections and the latent image carrier when the protective sheet is pulled out along the peripheral direction of the latent image carrier.

17. The image forming unit of claim 4, wherein a surface roughness of the high friction portion is higher than a surface roughness of the protective portion.

18. An image forming apparatus comprising an image forming unit including:

a latent image carrier having formed at an outer peripheral surface thereof an image forming area where an image is formed and an area which is other than the image forming area;

a charging member that comes in contact with the outer peripheral surface of the latent image carrier and that charges the outer peripheral surface of the latent image carrier;

a presser that is pressed against the area; and a protective sheet that is pulled out along a peripheral direction of the latent image carrier and that includes:

a protective portion that is inserted between the charging member and the latent image carrier, the charging member being in contact with the outer peripheral surface of the latent image carrier, and the protective portion covering the image forming area; and an extended portion that is connected to an end portion of the protective portion in an axial direction of the latent image carrier and is extended in the peripheral direction of the latent image carrier, the extended portion having a high friction portion, the high friction portion being pressed by the presser toward the area, wherein a coefficient of friction of the high friction portion is higher than a coefficient of friction of the protective portion.

19. A protective sheet comprising:

a protective portion that is insertable between a charging member and a latent image carrier, the charging member being in contact with an outer peripheral surface of the latent image carrier, the protective portion being sized to cover an image forming area formed on the outer peripheral surface of the latent image carrier, the protective portion having opposite end sides which are substantially parallel to each other; and an extended portion that is extended from each of the opposite end sides and is extended in a direction substantially parallel to the opposite end sides, and the extended portion including a high friction portion, wherein a coefficient of friction of the high friction portion is higher than a coefficient of friction of the protective portion.

* * * * *